United States Patent [19]

Creaden

[11] Patent Number: 4,705,170

[45] Date of Patent: Nov. 10, 1987

[54] FLUORESCENT TUBE DUNNAGE

[75] Inventor: David E. Creaden, Lawrence, Kans.

[73] Assignee: Lawrence Paper Company, Lawrence, Kans.

[21] Appl. No.: 895,507

[22] Filed: Aug. 11, 1986

[51] Int. Cl.[4] ..... B65D 85/42

[52] U.S. Cl. ..... 206/419; 206/443; 206/585; 206/587; 206/593; 217/35

[58] Field of Search ..... 206/418, 419, 420, 443, 206/445, 585, 587, 591, 592, 593, 594; 217/27, 35; 220/23.8; 229/26.5 R

[56] References Cited

U.S. PATENT DOCUMENTS

| | | | |
|---|---|---|---|
| D. 202,580 | 10/1965 | Weiss . | |
| D. 249,638 | 9/1978 | Chadbourne . | |
| 1,347,909 | 7/1920 | Perris | 217/35 |
| 2,564,834 | 8/1951 | Devine et al. . | |
| 2,639,807 | 5/1953 | Ambrette et al. . | |
| 2,776,772 | 11/1957 | Itoda . | |
| 2,808,189 | 10/1957 | Williams . | |
| 2,815,856 | 12/1957 | Caswell . | |
| 3,018,015 | 1/1962 | Agriss et al. . | |
| 3,119,492 | 1/1964 | Burket . | |
| 3,120,901 | 2/1964 | Boyd . | |
| 3,143,274 | 8/1964 | Maize . | |
| 3,163,312 | 12/1964 | Chaplin . | |
| 3,195,770 | 2/1965 | Robertson . | |
| 3,219,232 | 11/1965 | Wilson . | |
| 3,223,234 | 12/1965 | Weiss . | |
| 3,282,458 | 11/1966 | Rudd . | |
| 3,379,340 | 4/1968 | Silvio . | |
| 3,398,840 | 8/1968 | Wilson . | |
| 3,497,102 | 2/1970 | Bessett et al. . | |
| 3,708,084 | 1/1973 | Bixler et al. . | |
| 3,771,646 | 11/1973 | Mascetti, Jr. . | |
| 3,777,885 | 12/1973 | Barteck . | |
| 3,786,932 | 1/1974 | Smith | 220/23.8 |
| 4,427,730 | 1/1984 | Robbins et al. . | |

FOREIGN PATENT DOCUMENTS

| | | |
|---|---|---|
| 645857 | 7/1962 | Canada . |

*Primary Examiner*—Stephen Marcus
*Assistant Examiner*—Brenda J. Ehrhardt
*Attorney, Agent, or Firm*—Schmidt, Johnson, Hovey & Williams

[57] ABSTRACT

Molded synthetic resin dunnage supports for packing of elongated fragile fluorescent tubes are provided which are designed for automated dispensing during packaging and give protection against tube breakage at least equivalent to that of conventional molded pulp supports. In preferred forms, the dunnage support is formed from polyvinyl chloride sheet material (0.014 inch thickness) and includes plural juxtaposed tube-receiving sockets together with a rear side lip and front side ledge platforms; the lip carries laterally spaced upright nibs which, in conjunction with the ledge platforms, prevent complete nesting of the supports, so that an interfitted support stack presents substantially even access spaces between individual supports for easy machine dispensing. The tube-receiving sockets are provided with alternating, vertically spaced, upwardly and downwardly opening arcuate, striated tube-engaging sections so that a single support can simultaneously engage and cushion a pair of tube layers in a shipping carton. The dunnage design affords a high degree of protection for the packaged tubes and can safely absorb potentially destructive impacts without tube breakage.

7 Claims, 9 Drawing Figures

FLUORESCENT TUBE DUNNAGE

BACKGROUND OF THE INVENTION

1. Field of the Invention

The present invention is broadly concerned with synthetic resin dunnage supports designed for cushioning and protecting elongated fluorescent tubes during packing and shipping thereof. More particularly, it is concerned with such supports which are especially configured to permit automated dispensing of individual supports during the packaging process, while giving essentially equivalent or superior protection to the tubes, as compared with conventional dunnage formed of molded pulp material.

2. Description of the Prior Art

Generally speaking, elongated fluorescent tubes are packaged in long corrugated paper cartons. In order to protect the tubes during packaging and in transit, the respective ends of the tubes are normally supported by inserts or dunnage elements. Typically, such dunnage elements include elongated tube-receiving sockets, together with design configurations (e.g., hollow triangular marginal wall portions) which serve to absorb potentially destructive impact forces.

Heretofore, most commercially used tube supports have been formed from molded pulp or paperboard. This material can be readily fabricated in desired shapes, is low in cost, and provides the requisite degree of protection against tube breakage. However, molded pulp dunnage elements suffer from a significant problem relating to the handling and packaging thereof. That is to say, many manufacturers would prefer to package their fluorescent tubes on a completely automated basis. This in turn necessitates that the dunnage elements employed be machine dispensable. Experience has proved though that pulp supports have a tendency to stick together when nested in a stack, to the point that automated dispensing machines simply cannot be used on an efficient basis. In fact, it has been the practice to position a worker at the dispensing station in order to clear the constant hang-ups of paperboard supports and to assure relatively smooth operation of the automated dispensing equipment. As can be appreciated, use of a worker in this context largely negates the cost advantage of automated dispensing.

The problems of dispensing paperboard dunnage elements are believed to stem from the fact that these elements are of varying thicknesses and quality. Moreover, during high humidity conditions these elements tend to adhere to one another, which further compounds the separation and dispensing problem.

In short, the molded pulp dunnage of the prior art is seriously deficient from the standpoint of easy, cost effective handling and dispensing thereof, and therefore fluorescent tube manufacturers have been searching for an acceptable substitute which meets the dictates of automated handling.

SUMMARY OF THE INVENTION

The present invention overcomes the problems noted above, and provides synthetic resin dunnage supports which are particularly designed for fast, sure, individual automated dispensing while at the same time giving tube protection essentially equivalent or superior to conventional molded pulp dunnage.

In preferred forms, the tube support of the invention is in the form of an integral body fabricated from thin synthetic resin sheet material (e.g. polyvinyl chloride having a thickness of from about 0.13 to 0.018 inches). The integral body has concavo-convex walls presenting a number of elongated, open top, parallel, juxtaposed concave tube-receiving regions or sockets, and corresponding convex underside wall surfaces. Moreover, the integral tube support is provided with spacer means which prevents complete nesting of plural supports and serves to define substantially uniform, elongated, laterally-extending spaces between adjacent interfitted supports. In this fashion, automatic dispensing equipment can be used for dispensing of the supports on an individual basis from a stack thereof.

Preferably, the dunnage support is provided with an elongated, rearward extending, thin rear side lip having an underside presenting an abutment surface. Each lip in turn carries spacer means for preventing complete nesting of plural supports in a stack, to define the aforementioned substantially uniform, elongated, laterally extending spaces between adjacent interfitted supports in order to allow insertion of automatic dispensing equipment therebetween. The lip spacer means is advantageously in the form of a plurality of upstanding, laterally spaced apart nibs carried by the lip. Such nibs should have a vertical height of at least about $\frac{1}{8}$ inch and preferably from about $\frac{1}{8}$ to $\frac{3}{8}$ inches in height. Furthermore, the front edge of each support is advantageously formed to provide ledge structure serving to maintain the desirable spacing between individual interfitted tube supports.

The nibs carried by respective element lips are also preferably laterally offset from one another, so that in a stack of interfitted supports positive spacing between the supports is assured. In like manner, the front side ledges are alternately arranged in respective interfitted supports so as to provide the needed spacing function. Accordingly, at least two separate molds are employed in the fabrication of the dunnage supports in order to provide the alternating nib and ledge arrangement in accordance with the invention. In actual practice, many (e.g., five) separate molds are used, each with a correspondingly different nib and alternate ledge placement, so that in an upright, interfitted stack of the supports, a particular style of support occurs only every sixth support.

The dunnage support of the invention also includes a number of unique features serving to provide adequate breakage protection for the fluorescent tubes. In particular, the concavo-convex socket-defining walls of the supports preferably include a first plurality of axially spaced apart, upwardly opening and diverging tube-engaging arcuate first sections each having a radius conforming with the circular sidewall of a fluorescent tube. Moreover, a second plurality of axially spaced apart, downwardly opening and diverging tube-engaging arcuate second sections are also provided, and here again these second sections have a radius conforming with the circular sidewall of a fluorescent tube. The upwardly opening first sections, and the downwardly opening second sections, are alternated along the length of each of the tube-receiving sockets, with the downwardly opening sections being located vertically below the upwardly opening sections. In this fashion, a single dunnage support can engage and protect two layers of fluorescent tubes, while the spaced apart tube-engaging sections give cushioned protection to the tubes. Such protection is enhanced by provision of striations or small cushioning ribs in the faces of each of the tube-engaging sections. Such ribs have been found to further absorb destructive impact in order to fully protect the fluorescent tubes.

DESCRIPTION OF THE PREFERRED EMBODIMENTS

Figure 1:
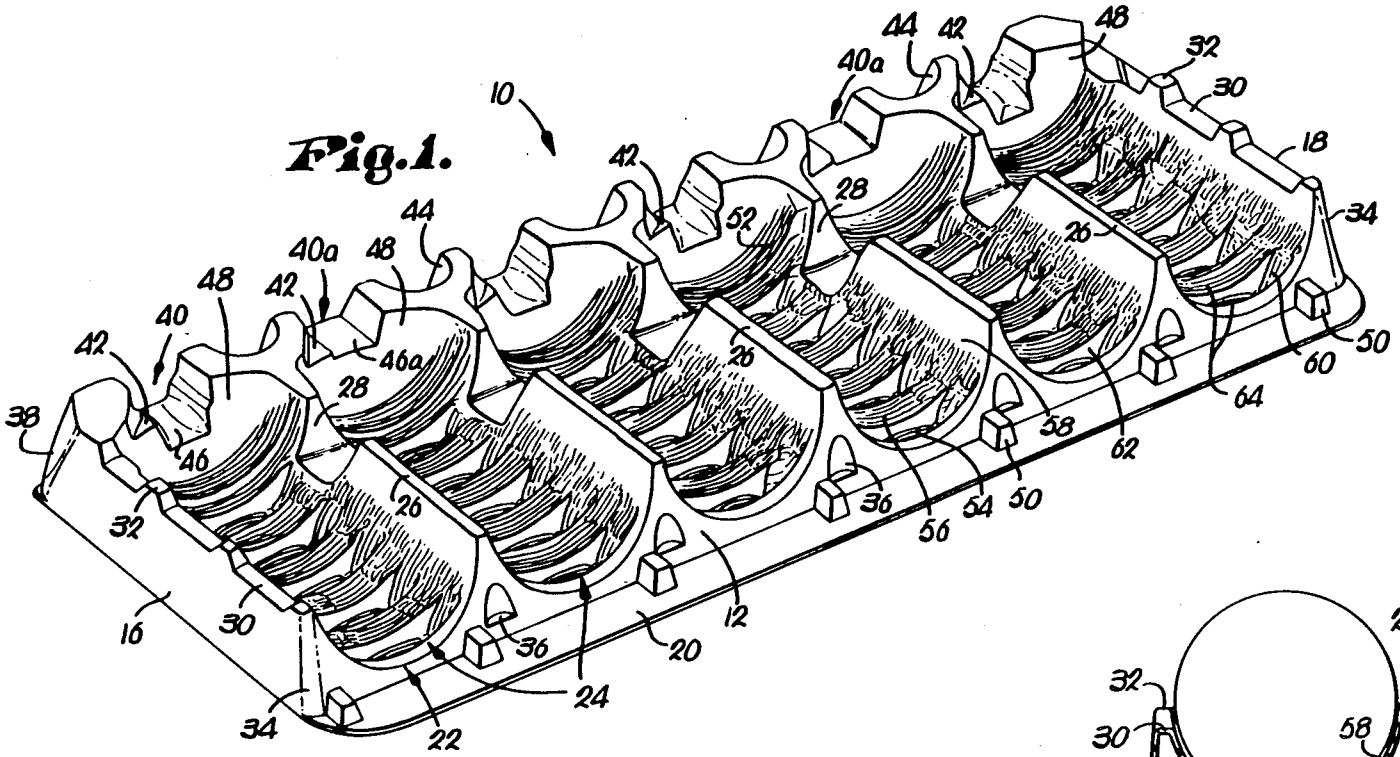
FIG. 1 is a perspective view of a dunnage support in accordance with the invention.

Turning now to the drawings, a dunnage support 10 is illustrated in FIGS. 1–6. The support 10 is in the form of an integral, thermo-formed body of synthetic resin material. Most preferably, the material is polyvinyl chloride sheeting having an initial thickness before forming of 0.014 inches.

The support 10 includes an upstanding rear sidewall 12, an opposed, upstanding hollow front sidewall 14, opposed end walls 16, 18, and a rearwardly extending rear side lip 20.

The overall support 10 is further provided with a total of six concavo-convex wall sections 22 which cooperatively present a plurality of individual, elongated, open-top, parallel, juxtaposed concave tube-receiving sockets or regions 24. It will be noted in this respect that the regions 24 terminate at rear wall 12, and accordingly, the wall 12 presents in overall configuration a scalloped appearance. The wall sections 22 are joined at their respective apices by means of elongated, rectangular, fore and aft extending connector walls 26, the latter being notched as at 28 adjacent front wall 14. The endmost wall sections 22 are joined to the adjacent end walls 16, 18, by means of a similar connector wall 30, each of the latter being provided with three spaced apart upstanding spacers 32.

In more detail, it will be seen that rear sidewall 12 is integrally joined with each of the sidewalls 16, 18, at smooth, rounded rear corners 34. Moreover, the wall 12 is provided with a total of five formed recesses 36 therein, respectively located directly beneath an associated connector wall 26 in the region between the tube-receiving regions 24.

Figure 3:
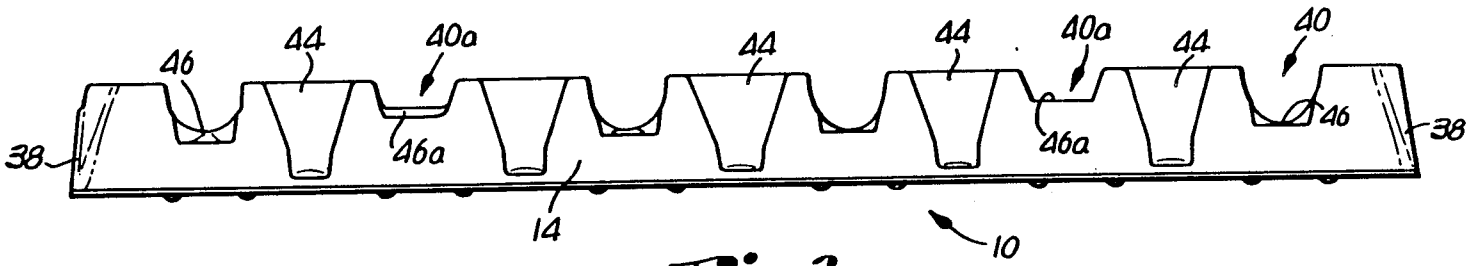
FIG. 3 is a side elevational view of the support illustrated in FIGS. 1 and 2, viewing the front side thereof.

Attention is next directed to FIGS. 1 and 3 which depict the particular construction of front wall 14. In this regard, it will be seen that the front wall 14 is integrally connected with the sidewalls 16, 18 at smooth, rounded corners 38. Moreover, the front wall 14 includes a series of openings 40 therein respectively in communication and alignment with the corresponding tube-receiving regions 24. It will be noted that four openings 40 of relatively deep configurations are provided, along with two openings **40*a* of somewhat shallower configuration. The openings 40, 40*a* are designed to receive and accommodate the connector prongs of fluorescent tubes received within the supports, as those skilled in the art will readily appreciate. However, it will be observed that each of the recesses 40, 40*a*, at the left hand margin thereof as viewed in FIGS. 1 and 2, includes a somewhat triangularly-shaped ledge or platform 42 and a correspondingly shaped relieved zone. As explained previously, other embodiments of the support provide a different placement for the platforms 42 and relieved zones. In particular, in another embodiment of the invention, the platforms 42 and relieved zones are provided at the righthand margin of each recess 40, 40*a*, as opposed to the configuration specifically depicted in FIG. 1. Thus, and considering an interfitted stack of the tube supports, the left and righthand placement of platforms 42** would alternate in the stack so as to establish and maintain a proper spacing between individual interfitted supports.

Figure 2:
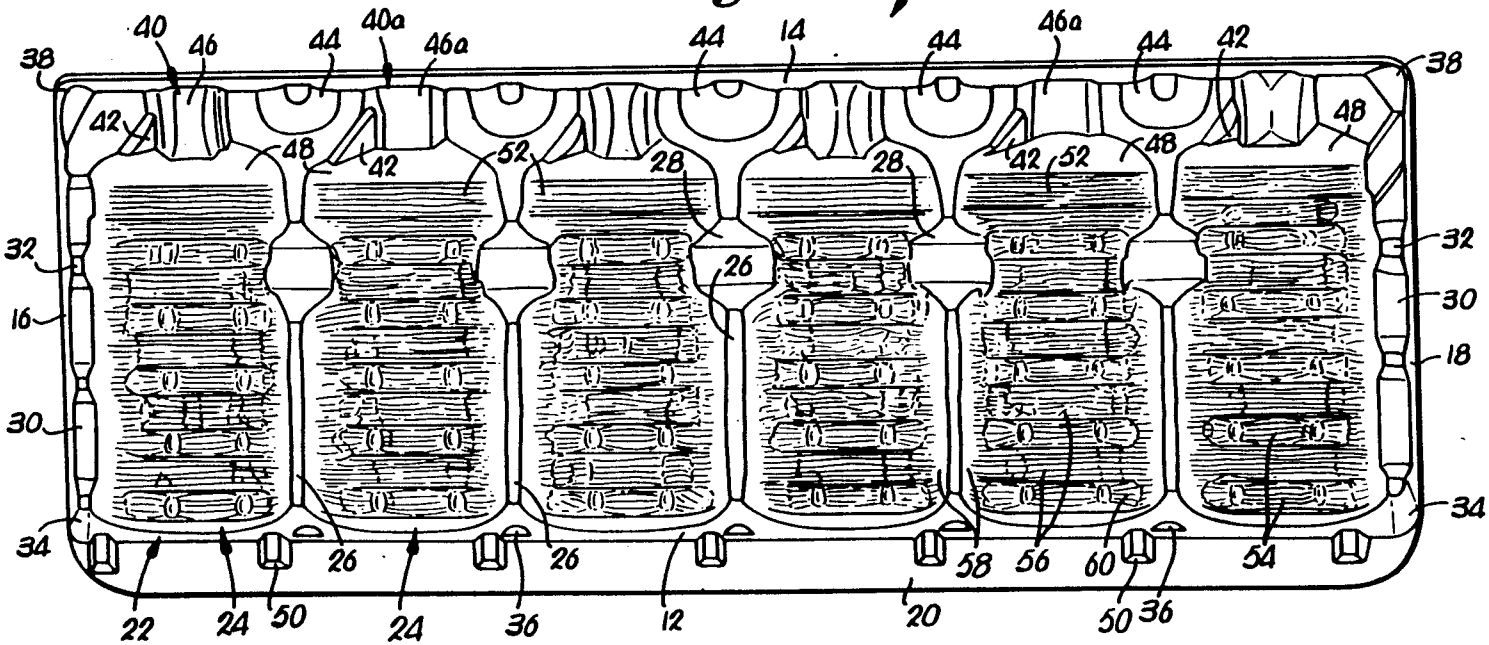
FIG. 2 is a plan view of the support depicted in FIG. 1.
Figure 4:
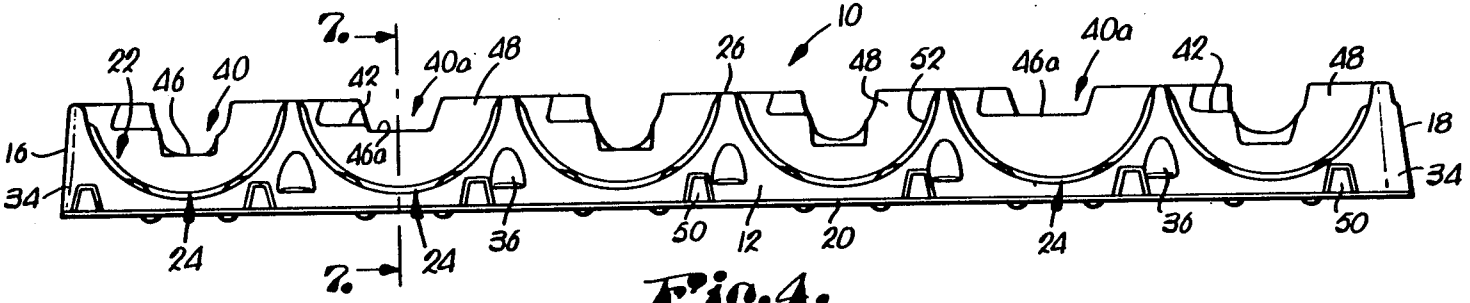
FIG. 4 is a side elevational view of the dunnage support of FIGS. 1–3, depicting the rear side thereof.
Figure 5:
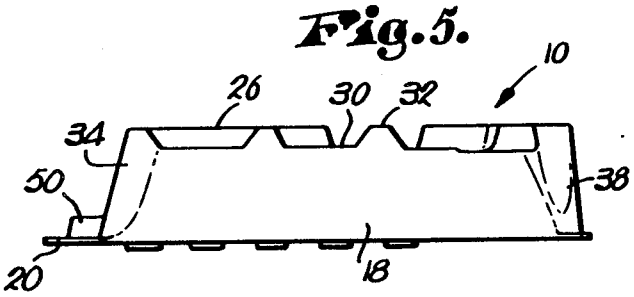
FIGS. 5 and 6 and respective end elevational views of the dunnage support.
Figure 6:
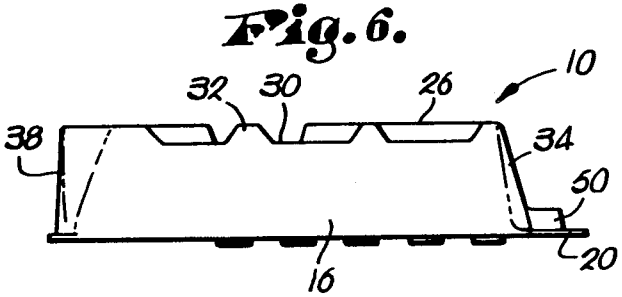

Referring particularly to FIGS. 2 and 3, it will further be seen that front wall 14 is provided with a total of five somewhat triangularly shaped, arcuate in cross section, open top, upwardly diverging recessed zones 44. These zones are defined by correspondingly shaped indentations in wall 14 as will be readily seen, with such indentations being in opposed relationship to each of the five connector walls 26 (see FIG. 2). As a result of this configuration, it will be perceived that each of the connector walls 26, at the region of front wall 14, is somewhat Y-shaped in configuration, with the base of the Y extending from the corresponding notch 28, and with the bifurcated portion thereof surrounding and defining the upper end of each zone 44. As readily observable from FIGS. 1 and 2, front wall 14 presents an effective thickness attributable to the noted Y-shaped sections together with the bottom walls 46 and **46*a* of the respective openings 40 and 40*a*. In addition, the overall front wall 14 presents an upright inner surface in the form of respective arcuate walls 48 joined to the Y-shaped sections and opening-defining walls and extending downwardly therefrom for joinder with the concavo-convex walls 22. The arcuate walls 48 in turn define an upright abutment surface for the end of a fluorescent tube situated within each corresponding region 24**.

Rear side lip 20 is provided with a plurality, here seven, of upstanding spacer nibs 50. As illustrated, the nibs 50, in the depicted embodiment, are located at the ends of the lip 20, and just to the left of each recess 36. The purpose of these nibs 50 will be made clear hereinafter.

Each of the concavo-convex wall sections 22 include a stepped, arcuate, end cap-receiving wall portion 52 which extends rearwardly from each associated wall 48 and terminates at the frontmost end of the associated notches 28 as shown. The wall portion 52 as indicated receive the metallic end caps provided on the fluorescent tubes.

The remainder of the concavo-convex wall sections extending rearwardly from the portions 52 to rear wall 12 are in the form of alternating downwardly and upwardly opening, vertically spaced apart arcuate tube-engaging wall sections 54, 56. That is to say, the majority of the length of each concavo-convex wall section 22 includes a plurality of axially spaced apart, arcuate, upwardly opening and diverging wall sections 56 presenting a radius of curvature conforming to that of the sidewall of a fluorescent tube. These spaced apart wall sections 56, at their respective side margins, merge into and form a part of similarly curved main sidewall portions 58 which extend upwardly and are integral with the upper connector walls 26.

Figure 8:
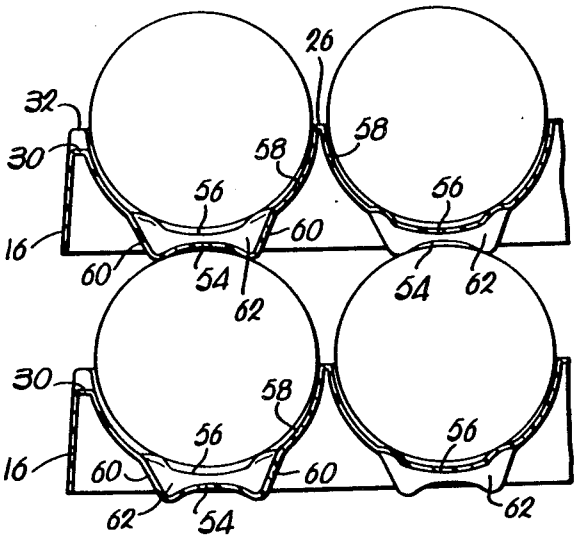
FIG. 8 is a fragmentary vertical sectional view illustrating a pair of dunnage supports in use, with the supports in operative, supporting engagement with fluorescent tubes.
Figure 7:
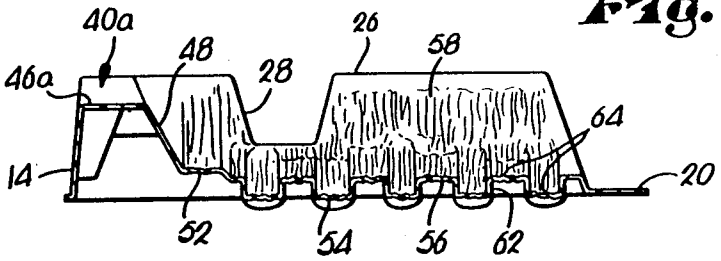
FIG. 7 is a sectional view taken along line 7—7 of FIG. 4.

The concavo-convex walls 22 further include a second plurality of downwardly opening and diverging wall portions 54 which similarly have a radius of curvature conforming to the sidewall of a fluorescent tube. The respective marginal ends of each wall section 54 are joined with upwardly extending walls 60 (see FIG. 8) which extend upwardly to merge into main wall portion 58. The alternating walls sections 54, 56 are joined together by means of vertical walls 62 in order to maintain the wall sections in vertically spaced relationship to one another. As best seen in FIG. 8, each upwardly opening wall section 56 is spaced above the adjacent wall section 54. Indeed, the lateral side margins of the wall sections 54 extend slightly below the bottom edge of the sidewalls 16, 18, and rear wall 14.

Each of the wall sections 54, 56 is provided with a plurality of relatively small cushioning striations or ribs 64 formed therein during the vacuum forming process of the dunnage support 10. In like manner, each end cap-receiving wall portion 52 is similarly striated. Hence the wall sections 54, 56 each present an undulating, tube-engaging surface.

The element 10 is formed in a female mold so that the thickness of each of the upper connector walls 26, 30 is greater than that of the lower downwardly opening wall sections 54. Indeed, the thickness of the endmost portions of the wall sections 54 are on the order of 0.004 inch, and are effectively transluscent. On the other hand, the connector walls 26, 30 are virtually the same thickness as the starting sheet material, or preferably about 0.014 inch.

Figure 9:
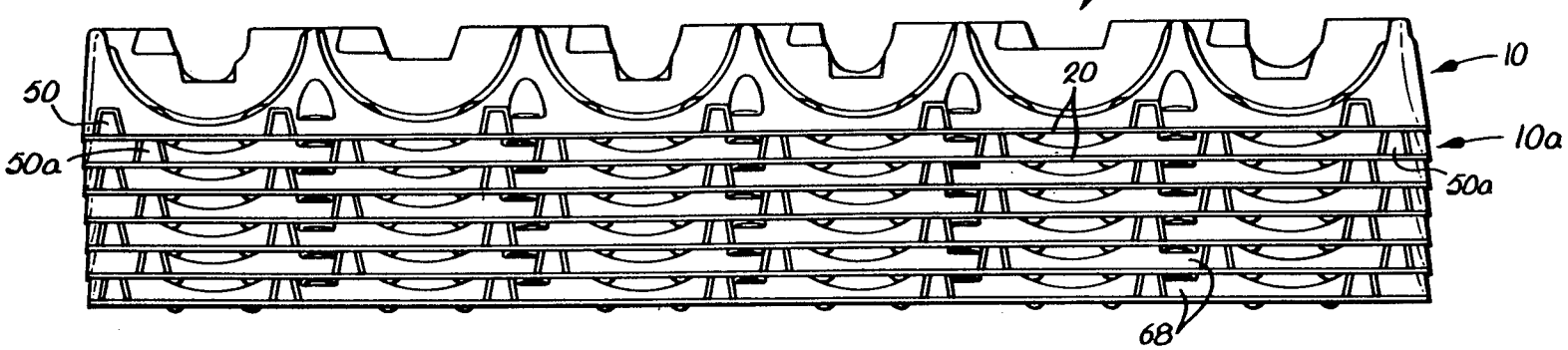
FIG. 9 is a front side elevational view of an interfitted stack of dunnage supports in accordance with the invention, illustrating the provision of substantially uniform, laterally extending spaces between individual supports permitting ready machine dispensing of the supports.

Attention is next directed to FIG. 9 which depicts a vertical stack 66 of interfitted dunnage supports in accordance with the invention. This stack is made up of two particular embodiments of the dunnage supports, namely the supports 10 fully described above, together with alternating supports 10*a*. The supports 10*a* are in all respects identical with the supports 10, save for the fact that in the supports 10*a*, the nibs 50*a* thereof are laterally offset from the nibs 50 of the supports 10, and the ledges or platforms thereof (not shown) are laterally offset from the platforms 42. As a consequence of this construction, it will be seen that the nibs 50, 50*a* alternate in a stairstep fashion throughout the stack 66; furthermore, the spacing platforms of the supports 10, 10*a* similarly alternate in a stair-step fashion. By virtue of this configuration, each of the nibs 50, 50*a* contacts the planar underside of the lip of the support next above in the stack; likewise, each individual set of ledges or platforms engages the full heighth wall of the Y-shaped section of the next adjacent support. The heighth of the nibs and the vertical recess of the platforms are correlated so as to maintain an even spacing between individual supports about the entire periphery thereof. This prevents full nesting of the respective supports 10, 10*a* and effectively presents a series of substantially even, elongated spaces 68 between individual dunnage supports in the stack 66. As a consequence, the stack 66 can be placed in automatic dispensing equipment, and the spaces 68 afford adequate clearance for the insertion of dispensing equipment between individual supports in the stack. Thus, such dispensing equipment can be used to good effect to achieve easy, high speed automated dispensing of the individual supports.

Although PVC having a thickness of 0.014 inch is the preferred sheet material for use in forming the supports of the invention, other current or future equivalent materials may also be used. For example, it is believed that thermoplastic polyester or polyethylene terephthalate synthetic resins can also be used to good effect in the invention, with the thicknesses of these materials being substantially the same as outlined above. In order to provide the most advantageous protection for the fluorescent tubes, it is preferred to employ synthetic resin materials having a durometer value (Shore D per ASTM D-2240) of from about 80 to 90 (most preferably 84), and a modulus of elasticity of from about 400,000 to 440,000, ASTM D-790 (most preferably 420,000). The most preferred PVC material further has a specific gravity 1.35, ASTM D-792; a tensile strength of 6750 psi, ASTM D-638; a tensile modulus of 315,000 psi, ASTM D-638; a flexural modulus of 420,000 psi, ASTM D-790; and a deflection temperature at 264 psi of 58° C., ASTM D-648.

In addition, the various structural features of the dunnage supports assures that a package of fluorescent tubes with individual supports between respective layers thereof can withstand potentially destructive impact forces. That is to say, a given package containing four layers of tubes would make use of five dunnage supports at each end of the tubes, with four of the supports receiving the tubes as illustrated in FIG. 8, and with one support being inverted. In any event, actual testing with the dunnage elements hereof has proved that they are fully capable of supporting and protecting fluorescent tubes in a manner at least equivalent to conventional pulp dunnage supports. Such protection is believed to stem from the inherent flexibility of the synthetic resin material, and also by virtue of the striations 64 provided on the tube-engaging surfaces. Furthermore, the various recesses such as the notches 28 and zones 44, afford a controlled collapse to the dunnage elements which has been found to safely absorb potentially destructive forces.

In addition to the foregoing, it has been found that it is advantageous to provide a spacing between the longitudinal axes of adjacent pairs of tube-receiving regions 24 slightly differently than the spacing between other pairs of axes. This slight differential is in itself believed to enhance the protective function during an impact situation. To further enhance the protective function, the shape, spacing, contours, dimensions and ribbed texture of the areas 54, 56, 58, 60 and 62 are individually shaped to be slightly different from one another.

Finally, it will also be noted that the central connector wall 26 is slightly wider than the remaining connector walls on either side thereof. This not only enhances the strength of the central section of the support, but also facilitates automated insertion of thin vertical corrugated material between the central tubes during the packing process.

As indicated above, a prime feature of the present invention resides in the provision of dunnage supports designed to only incompletely nest in a stack thereof so as to present uniform spacings between pairs of elements and thus facilitate machine dispensing thereof. While in the preferred form of the invention use in made of an alternating nib and ledge arrangement respectively located along the rear and front side edges of the supports, the invention is not so limited. Thus, it will be appreciated that there are a multitude of ways to form spacing elements in the supports themselves in such a manner as to insure the partial nesting feature described above. All such equivalents are therefore deemed to be within the spirit and scope of the present invention.

I claim:

1. A fluorescent tube support, comprising:

an integral body formed from synthetic resin sheet material having a thickness prior to forming of from about 0.013 to 0.018 inch, said body having a front margin presenting an elongated, laterally extended lowermost surface, concavo-convex walls defining a number of elongated, open-top, parallel, juxtaposed, concave tube-receiving regions and corresponding convex underside wall surfaces, with elongated top walls between juxtaposed upwardly opening regions, said region-defining walls including a first plurality of axially spaced apart, upwardly opening and diverging tube-engaging arcuate first wall sections each having a radius generally conforming with the circular sidewall of a fluorescent tube, and a second plurality of axially spaced apart, downwardly opening and diverging tube-engaging arcuate second wall sections each having a radius generally conforming with the circular sidewall of a fluorescent tube, said upwardly opening first wall sections and said downwardly opening second wall sections alternating along the length of each of said regions, the lateral ends of said downwardly opening wall sections being at the vertically lowest extent of said support when the support is horizontally oriented, there being upright wall sections interconnecting said first and second wall sections, said first and second tube-engaging wall sections each being formed with undulating tube-engaging surfaces; and spacer means for preventing complete nesting of plural supports and to define substantially uniform, elongated, laterally extending spaces between adjacent interfitted supports for insertion of automatic dispensing equipment therebetween, said spaces having a vertical height of at least about $\frac{1}{8}$ inch, said spacer means including structure for creating a vertical space between the top walls of adjacent interfitted supports in a stack thereof to facilitate separation of individual supports from said stack.

2. The tube support as set forth in claim 1, said first and second tube-engaging wall sections each having a plurality of elongated, side-by-side ribs formed therein.

3. The tube support as set forth in claim 1, said top walls being slightly thicker than said second wall sections.

4. The tube support of claim 1, said spacer means comprising an elongated, rearwardly extending rear side lip having an underside presenting an abutment surface, and a plurality of upstanding, laterally spaced apart nibs carried by said lip, said nibs having a vertical height of at least about $\frac{1}{8}$ inch.

5. The tube support of claim 1, said spacer means including structure presenting a plurality of laterally spaced apart ledge platforms oriented along the front side edge of the support and positioned for preventing complete nesting of plural supports.

6. The tube support of claim 1, said sheet material being polyvinyl chloride.

7. The tube support of claim 1, the distance between the longitudinal axes of certain adjacent pairs of said tube-receiving regions being slightly different than the distance between the longitudinal axes of other adjacent pairs of said tube-receiving regions.

* * * * *